US008534680B1

(12) United States Patent
Corbeil et al.

(10) Patent No.: US 8,534,680 B1
(45) **Date of Patent: *Sep. 17, 2013**

(54) ICE SKATE BLADE ASSEMBLY

(71) Applicant: Bauer Hockey, Inc., Exeter, NH (US)

(72) Inventors: Jean-Francois Corbeil, Prevost (CA); Conrad Payeur, Prevost (CA); Ivan LaBonte, Montreal (CA); Sebastien Dubois, St-Jerome (CA)

(73) Assignee: Bauer Hockey, Inc., Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/864,720

(22) Filed: Apr. 17, 2013

Related U.S. Application Data

(63) Continuation of application No. 13/013,278, filed on Jan. 25, 2011, now Pat. No. 8,454,030.

(51) Int. Cl.
*A63C 1/30* (2006.01)

(52) U.S. Cl.
USPC ..... 280/11.18

(58) Field of Classification Search
USPC ..... 280/11.18, 841; 403/16
See application file for complete search history.

(56) References Cited

U.S. PATENT DOCUMENTS

| | | | | |
|---|---|---|---|---|
| 5,088,749 | A * | 2/1992 | Olivieri | 280/11.18 |
| 5,123,664 | A * | 6/1992 | DeMars | 280/11.18 |
| 2010/0109312 | A1* | 5/2010 | Salmon et al. | 280/841 |
| 2011/0121527 | A1* | 5/2011 | Salmon et al. | 280/11.12 |

FOREIGN PATENT DOCUMENTS

| | | |
|---|---|---|
| CH | 223321 | 9/1942 |
| WO | 2010/009532 A1 | 1/2010 |

OTHER PUBLICATIONS

Extended European Search Report issued by the European Patent Office on Jul. 11, 2011 in connection with European Patent Application Serial No. 11 152 034.2, 6 pages.

* cited by examiner

*Primary Examiner* — John R Olszewski
*Assistant Examiner* — Hilary L Johns

(57) ABSTRACT

An ice skate blade assembly comprising an ice skate blade comprising first and second hooks projecting upwardly, a blade holder having a bottom portion having a longitudinal groove extending therealong for receiving the upper edge of the ice skate blade and wherein the bottom portion further defines a recess extending upwardly from the longitudinal groove for receiving the first hook, and a single actuator having a wall accessible by a finger of a user, a resilient portion having an end wall facing a section of the inner surface of the second pedestal and a base with an inner wall and a bottom wall having an upper surface, an end and a bottom surface, wherein the inner wall and the bottom wall define therebetween a channel opens to the bottom aperture for receiving the second hook.

23 Claims, 11 Drawing Sheets

ICE SKATE BLADE ASSEMBLY

CROSS-REFERENCE TO RELATED APPLICATION

This application is a continuation application of U.S. application Ser. No. 13/013,278 filed on Jan. 25, 2011, the contents of which are incorporated herein by reference in their entirety.

FIELD OF THE INVENTION

The present invention relates to an ice skate blade assembly comprising a skate blade attachment system that allows to a user to quickly secure the ice skate blade to the blade holder and to quickly release the ice skate blade from the blade holder. The attachment system is easy for the user to use and does not require the assistance of hand tools. Moreover, the attachment system allows the user to replace ice skate blades without first having to remove the skate from his/her foot.

BACKGROUND OF THE INVENTION

Forming ice skate assemblies with a provision for the replacement of the ice skate blade is well known in the art.

Commonly, such assemblies comprise a blade holder molded from a thermoplastic material with a longitudinal groove extending therealong and within which the ice skate blade is received.

In accordance with a first prior assembly, the ice skate blade is locked to the blade holder by two or more threaded fastener means (such as a nut and bolt assembly) that pass transversely through the blade and blade holder at intervals which are longitudinally spaced apart. This arrangement permits the rapid replacement of the blade through the use of two simple tools.

In accordance with a second prior assembly, the ice skate blade is locked to the blade holder by two or more threaded fastener means that pass upwardly through the blade holder. This second means of locking the blade to the blade holder permits the blade to be strongly biased in contact with the blade holder. However, a deficiency in this second prior assembly is that the replacement of the blade usually requires demounting the blade holder from the skate boot in order to gain access to the threaded fastening means so that the blade may be released from the blade holder.

Another deficiency in the first and second prior assemblies described above is the need to use two or more fastener means. The use of these fastener means renders the process of changing the ice skate blade both cumbersome and time-consuming for the user.

In accordance with a third prior assembly, the ice skate blade comprises a hooked portion at the front and a projection with a fastener aperture at the rear. The blade holder has a recess for receiving the front hooked portion and a bore hole for receiving a fastener having a threaded portion and a head that registers within the rear fastener aperture. A nut is screwed on the threaded portion of the fastener for retaining the blade in place. However, a known deficiency in the third prior assembly is that the replacement of the blade requires passing a tool through a hole provided in the sole of the skate boot to access the nut screwed on the threaded portion of the fastener in order to disengage the head of the fastener means from the bore hole and thus release the blade from the blade holder.

U.S. Pat. No. 5,123,664 shows a skate blade assembly wherein the front end of the ice skate blade is pivotably coupled to the blade holder via a slot and pin arrangement.

The rear end of the skate blade is then pivoted into snap-locking engagement with a locking mechanism located at the rear end of the blade holder, which locking mechanism comprises several pieces including springs, slide bar, latching tongue, ejection rod, rod and pin. A known deficiency of this assembly is that it comprises several pieces, thereby increasing the complexity of its construction and operation.

U.S. Publication No. 2010/0109312 shows a replaceable ice skate blade wherein the skate blade is attached to a removable blade assembly. The blade assembly comprises a first hook and pivotable rocker at its front end, as well as a second hook towards its rear end. The blade assembly is designed to be interlocked with an attachment system contained in the front and rear cavities of the holder, where the front cavity comprises a fixed retention hook for engaging the first hook of the blade assembly and the rear cavity comprises an attachment device that includes a pivotable retention hook at one end shaped to receive and engage the rearward hook of the blade assembly, a pawl that is attached to the pivotable retention hook, a releasing means (e.g., a button) and a spring that provides tension to the different components of the device.

To attach the skate blade and blade assembly to the holder, the user first presses the releasing means in order to overcome the force of the spring on the pawl, thus allowing the pivotable retention hook to move into a position that would allow the entry of the rearward second hook of the blade assembly. Next, the user engages the first hook with the fixed retention hook in the front cavity of the attachment system and rotates the blade assembly via the pivotable rocker so as to make the second hook enter the attachment device at the rear of the holder. The second hook makes contacts with and applies pressure to the pivotable retention hook within the attachment device. Once sufficient pressure is applied by the second hook of the blade assembly on the pivotable retention hook, the retention hook (and attached pawl) pivots, which subsequently releases the tension stored the spring and forces the pivotable retention hook into a position where it is physically engaged with the second hook of the blade assembly. However, a known deficiency of this assembly is that it comprises several separate pieces, thereby increasing the complexity of its construction and operation.

Consequently, there is a need in the industry to provide a simple attachment system having a single component that allows the ice skate blade to easily be locked to and removed from the blade holder by the user without the need of tools.

SUMMARY OF THE INVENTION

In accordance with a broad aspect, the invention provides an ice skate blade assembly for a skate, the ice skate blade assembly extending along a longitudinal axis and comprising: (a) an ice skate blade comprising first and second ends, an ice-contacting surface and an upper edge opposite to the ice-contacting surface, the upper edge comprising first and second hooks projecting upwardly proximate to one of the first and second ends respectively; (b) a blade holder having first and second pedestals and a bridge portion connecting the first and second pedestals, the blade holder further comprising a bottom portion having a longitudinal groove extending therealong for receiving the upper edge of the ice skate blade, the bottom portion further defining a recess extending upwardly from the longitudinal groove for receiving the first hook of the ice skate blade and wherein the second pedestal has an inner surface defining a cavity with a bottom aperture that opens to the longitudinal groove; and (c) a single actuator for selectively locking the ice skate blade into the blade holder and releasing the ice skate blade from the blade holder, the single actuator being at least partially mounted within the cavity of the second pedestal and comprising a finger-engaging surface accessible by at least one finger of a user from an exterior of the blade holder and a hook-receiving portion for receiving the second hook of the ice skate blade, the hook-receiving portion being movable between (i) a lock position, in which the hook-receiving portion engages the second hook of the ice skate blade to lock the ice skate blade in the longitudinal groove of the blade holder, and (ii) a release position, in which the hook-receiving portion disengages the second hook of the ice skate blade to release the ice skate blade from the blade holder, and wherein the hook-receiving portion is movable in response to the at least one finger of the user acting on the finger-engaging surface for imparting translation movement of the single actuator from the lock position to the release position.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of examples of implementation of the present invention is provided hereinbelow with reference to the following drawings, in which.

Figure 1:
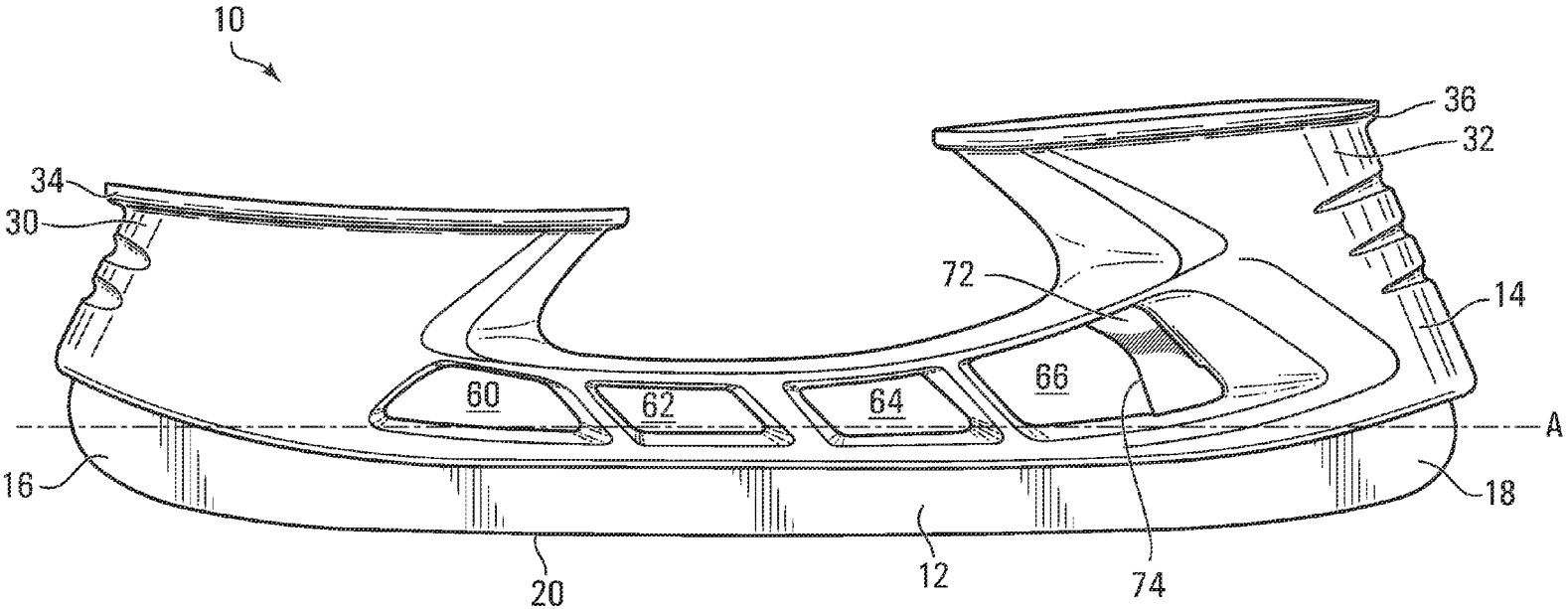
FIG. 1 shows an ice skate blade assembly in accordance with a non-limiting embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

FIGS. 1, 2 and 4 to 11 show an ice skate blade assembly 10 constructed in accordance with a non-limiting embodiment of the invention. The ice skate blade assembly 10 extends along a longitudinal axis A and has an ice skate blade 12 and a blade holder 14.

The ice skate blade 12 can be made of a stainless steel material that is durable and can maintain a sharp edge. In another embodiment, the ice skate blade can also comprise an upper section made of aluminium or plastic and a bottom section made of stainless steel. In a further embodiment, the ice skate blade can comprise a plurality of apertures for reducing its weight.

The blade holder 14 can be made of a lightweight, strong material such as NYLON™. The holder 14 can also be made from a transparent or translucent material capable of being seen through. The transparent or translucent material may be a polymeric material such as, ACRYLIC™, XYLAC™ or any type of translucent or transparent polycarbonate or other polymer.

The blade holder 14 can be manufactured using known processes, including but not limited to an injection molding process.

Figures 2, 2A:
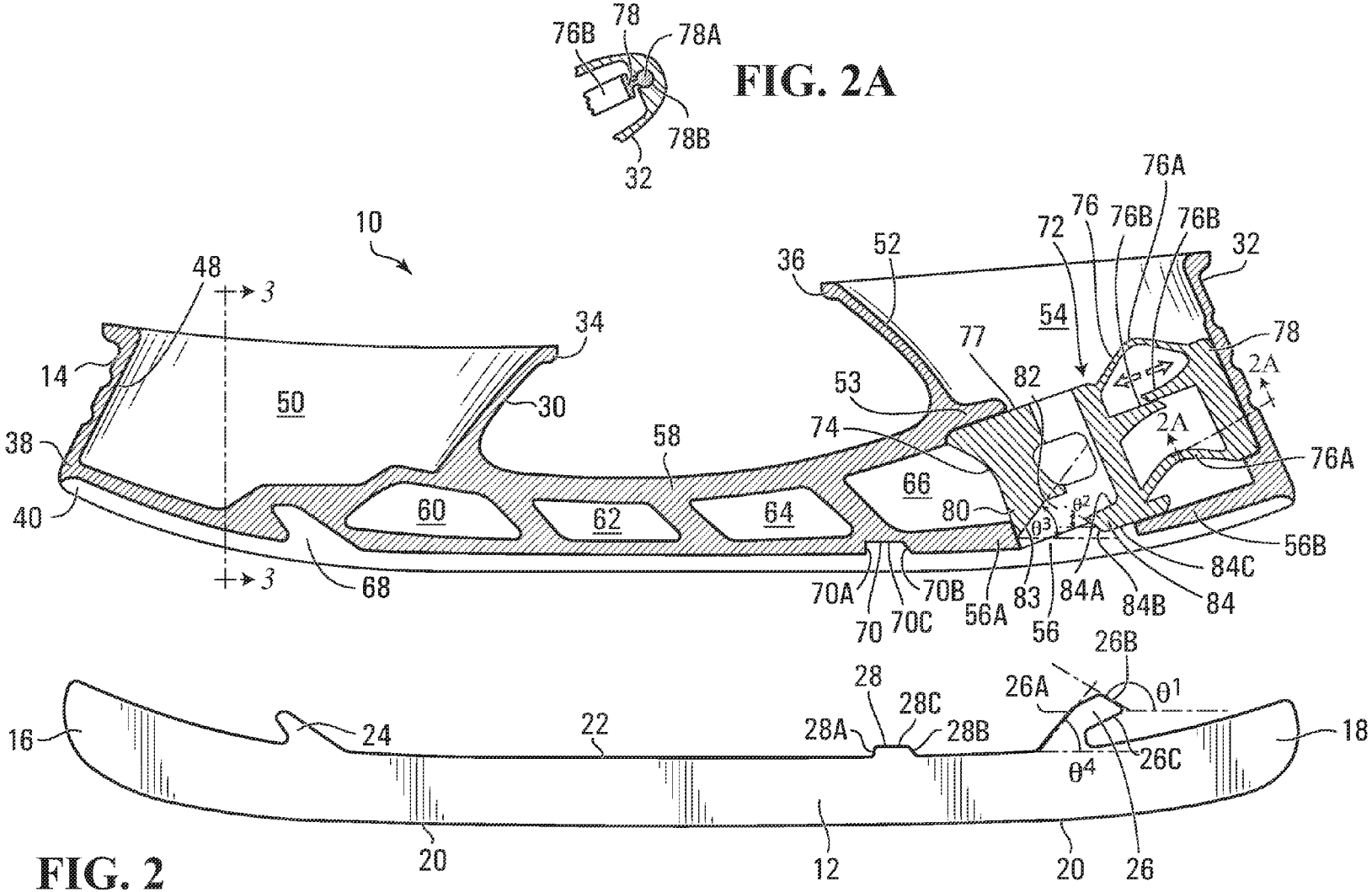
FIG. 2 shows a cross-sectional view of the ice skate blade assembly shown in FIG. 1.
FIG. 2A is a cross-sectional view taken along lines 2A-2A of FIG. 2.

Referring to FIG. 2, the ice skate blade 12 comprises a first end 16 and a second end 18, an ice contacting surface 20 and an upper edge 22 that is opposed to the ice contacting surface 20. The upper edge 22 comprises a first hook 24 that is upwardly projecting and proximate to the first end 16 of the ice skate blade 12. The upper edge 22 also comprises a second hook 26 that is upwardly projecting and which is generally located proximate to the second end 18 of the ice skate blade 12. The second hook 26 has an upper surface 26A, an end 26B and a bottom surface 26C.

The upper edge 22 further comprises a tooth 28 located between the first and second hooks 24, 26. The tooth 28 has first and second walls 28A, 28B extending upwardly and a top wall 28C. The second wall 28B may be an inclined wall projecting upwardly from the upper edge 22. As shown, the first and second hooks 24, 26 are the front and rear hooks of the ice skate blade 12 respectively, and the tooth 28 is closer to the second hook 26; but it will be understood that the first and second hooks 24, 26 may otherwise be the rear and front hooks of the ice skate blade and that the tooth 28 may rather be closer to the front hook in such an embodiment.

Moreover, in the ice skate blade 12, the first hook 24 projects forwardly towards the front of the blade holder 14, while the second hook 26 projects rearwardly towards the rear of the blade holder 14.

The blade holder 14 has first and second pedestals 30, 32 with respective top first and second top portions 34, 36 for attachment to a bottom surface of a skate boot (not shown). The blade holder 14 also has a bridge portion 58 connecting the first and second pedestals 30, 32. As is well known in the art, a skate boot (not shown) can comprise a rigid outsole glued to the bottom surface of the insole and the top portions 34, 36 of the blade holder 14 can be riveted to the outsole and insole. The blade holder 14 also comprises a bottom portion 38 having a longitudinal groove 40 extending therealong, and along the longitudinal axis A.

Figure 3:
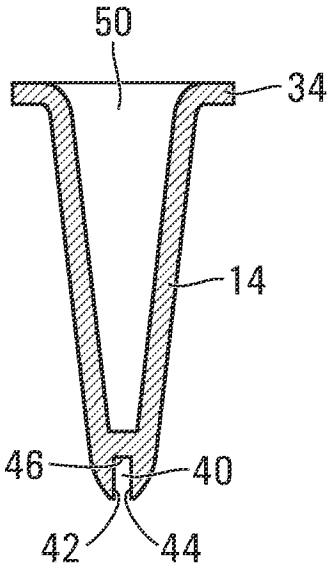
FIG. 3 is a cross-sectional view taken along lines 3-3 of FIG. 2.
Figure 7:
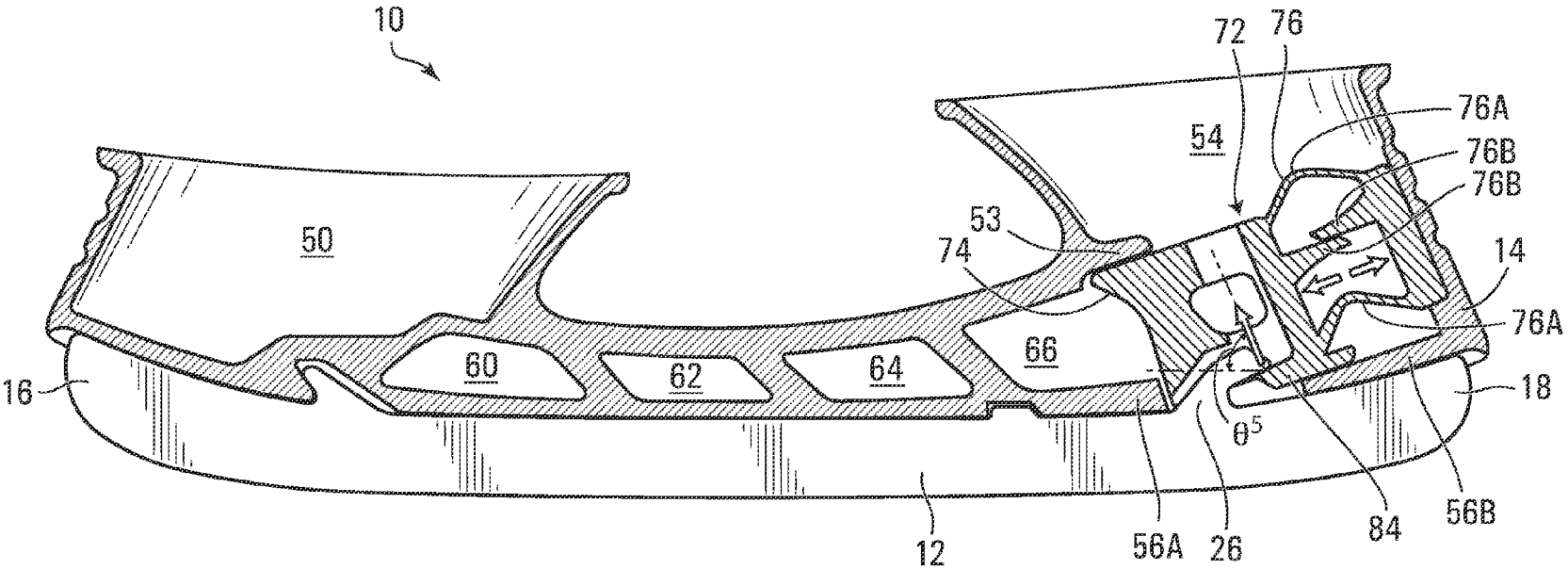
FIG. 7 is a cross-sectional view showing the ice skate blade in its locked position within the blade holder.

FIG. 3 shows that the longitudinal groove 40 is formed by laterally spaced walls 42, 44 extending downwardly from a bottom surface 46. As is best seen in FIG. 7, when the ice skate blade 12 is locked in place within the holder 14, the upper edge 22 of the ice skate blade 12 abuts the bottom surface 46. The longitudinal groove 40 is designed to receive the upper edge 22 of the ice skate blade 12. The width of the longitudinal groove 40 is almost identical to the one of the upper edge 22 and the depth of the groove 40 is sufficient in order that the upper edge 22 of the ice skate blade 12 can be tightly received within the longitudinal groove 40.

With reference to FIG. 2, the first pedestal 30 has an inner surface 48 defining a first cavity 50 and the second pedestal 32 has an inner surface 52 defining a second cavity 54 communicating with a bottom aperture 56 provided in the bottom portion 38 between first and second base walls 56A, 56B such that the bottom aperture 56 opens on to the longitudinal groove 40. The second pedestal 32 also comprises a protrusion 53 that extends rearwardly from a section of the inner surface 52 into the second cavity 54. As shown, the first and second pedestals 30, 32 are front and rear pedestal of the blade holder, but it may be understood that the first and second pedestals 30, 32 may otherwise be the rear and front pedestals of the blade holder.

The bridge portion 58 has first, second, third and fourth apertures 60, 62, 64, 66 for reducing the weight of the blade holder 14.

The bottom portion 38 also defines a recess 68 extending upwardly from the longitudinal groove 40 for receiving the first hook 24. The inner front wall of the recess 68 has a profile that generally matches the profile of the external front wall of the first hook 24, such that the first hook 24 can be tightly mounted within the recess 68 when the ice skate blade 12 is locked in place.

In the ice skate blade 12, the first hook 24 projects upwardly and forwardly and this first hook 24 is a front hook. Those skilled in the art will understand that the first hook would otherwise project upwardly and rearwardly in an embodiment wherein the first recess 68 is rather provided on the rear pedestal.

The bottom portion 38 further defines an indent 70 extending upwardly from the longitudinal groove 40 for receiving the tooth 28 of the ice skate blade 12. The indent 70 has first and second walls 70A, 70B extending downwardly and a top wall 70C. The second wall 70B may be an inclined wall. The indent 70 has an internal profile that generally matches the external profile of the tooth 28 such that one of the first and second walls 28A, 28B of the tooth 28 abuts against one of the first and second walls 70A, 70B of the indent 70 when the ice skate blade 12 is locked in place. In the embodiment where the first hook 24 is the front hook, the second (rear) wall 28B of the tooth 28 abuts against the second (rear) wall 70B of the indent 70 when the ice skate blade 12 is locked in place.

As best seen in FIG. 2, the ice skate blade assembly 10 also comprises a single actuator 72 having a wall 74 accessible by a finger of the user, a resilient portion 76 having an end wall 78 facing a section of the inner surface 52 of the second pedestal 32, an upper surface 77 and a bottom portion 80 with an inner wall 83 and a bottom wall 84 comprising an upper surface 84A, an end 84B and a bottom surface 84C where the inner wall 83 and the bottom wall 84 define therebetween a channel 82 for receiving the second hook 26. In the embodiment shown in the figures, the end wall 78 is a rear end wall that faces a rear section of the inner surface 52 of the second pedestal.

In one embodiment, the single actuator 72 may be made of an integrated part. In another embodiment, the single actuator may be made of two parts where the part comprising the resilient portion 76 can be compressed and inserted in the second cavity 54 after the other part in order to ease mounting of the single actuator 72 within the second cavity 54.

While the single actuator 72 may be made of one, two or more parts, in use, when it is mounted within the second cavity 54, all its movable components such as the finger accessible wall 74, channel 82, bottom wall 84 and resilient portion 76 are interdependent such that translation movement of any one of these components imparts corresponding translation movement of all the other components of the single actuator 72.

The part comprising the resilient portion may be made of a material that is slightly more flexible than the material of the other part, which may be made of more rigid material. One of the parts may be made of thermoplastic overmolded over a skeleton or frame made of metal such as stainless steel or aluminum. One of the parts (e.g. the one comprising the finger accessible wall) may be made of aluminum or stainless steel while the other part comprising the resilient portion can be made of a flexible resilient material. The finger accessible wall may be made of aluminium, stainless steel or thermoplastic with an overmolded region made of tactile material such as polyurethane.

The single actuator 72 may be made of thermoplastic material, such materials sold under the names ABS™, NYLON™, DELRIN™ (grades 900P, 500P, 500CL or 100ST) or ORGALLOY™ (grades LT5050 or RS600). The single actuator 72 may be molded or otherwise formed using techniques known in the art (e.g., plastic or metal injection molding).

As best seen in FIG. 2A, the end wall 78 may have a vertical projection 78A and the second pedestal 32 may have a vertical groove 78B provided on the inner surface 52 such that, after insertion of the single actuator 72 within the second cavity 54, the vertical projection 78A registers within the vertical groove 78B and the single actuator 72 is aligned within the second cavity 54. It is understood that the vertical projection 78A may be replaced by a vertical groove and the vertical groove 78B may be replaced by a corresponding vertical projection. It is also understood that the end wall 78 may be devoid of any vertical projection or groove and the inner surface 52 may be devoid of any vertical groove or projection such that the external surface of the end wall 78 abuts directly against a rear section of the inner surface 52.

Referring to FIGS. 2 and 7, the resilient portion 76 may comprise two resilient flaps 76A and two internal arms 76B that add rigidity to the resilient portion 76 for avoiding rotational or pivotal movement of the resilient portion 76 when pressure is applied upon it. It is understood that a resilient portion 76 with a number of flaps or inner arms greater than or less than two would also fall within the scope of the present invention.

In addition, the functionality of the resilient portion 76 could be provided by resilient components other than flaps. For example, a set of one or more resilient coil springs could be used for the resilient portion 76 and would likely provide similar, if not identical, functionality to the resilient portion 76 as do the resilient flaps of the present embodiment. In another alternate embodiment, the resilient portion 76 could be comprised of some combination of resilient flaps and resilient springs that provide equivalent functionality. The resilient portion 76 could also be made of external walls made of a resilient material and defining an internal cavity with a material such as foam in it.

Once the single actuator 72 is mounted in place, the user can insert one or two fingers in the fourth aperture 66 in order to press on the finger-accessible wall 74. It is understood that the rear surface of the end wall 78 and/or vertical projection 78A may be coated with glue or another adhesive substance before the single actuator 72 is inserted. This substance may permit a certain amount of movement to the end wall 78 during assembly, but after a certain period may permanently affix the end wall 78 to the rear section of the inner surface 52. Alternatively, glue or another adhesive substance (e.g. adhesive sold under the name LOCTITE™) or any locking means such as a screw can be applied or affixed at the top surface region between the end wall 78 (and/or vertical projection 78A) and the rear inner surface of the rear pedestal 32 (and/or the vertical groove 78B) once the single actuator 72 is mounted in the second cavity 54 in order to ensure proper mounting of the single actuator 72 in the second cavity 54. It is conceivable that the single actuator 72 could be removed after the assembly of the skate, such as in the case where a replacement actuator must be installed.

It will be appreciated that when the single actuator 72 is correctly aligned and placed within the second cavity 54 and there is no blade to be inserted or removed from the blade holder 14 as shown in FIG. 2, a top portion of the finger-accessible wall 74 exerts pressure against a bottom portion of the protrusion 53, a bottom portion of the finger-accessible wall 74 exerts pressure against the end of the base wall 56A and the end wall 78 exerts pressure against the inner surface 52, such that the pressure exerted by these portions helps keep the single actuator 72 seated properly within the second cavity 54. However, when the ice skate blade 12 is locked in place by the wedging action of the bottom wall 84 on the second hook 26 as shown in FIG. 7, there is no contact between the finger-accessible wall 74 and any portion of the second pedestal 32 and an upward force (see single large arrow in FIG. 7) is applied by the bottom wall 84 on the second hook 26 due to the remaining tension contained in the resilient portion 76 (see opposing large arrows in FIG. 7).

Figure 4:
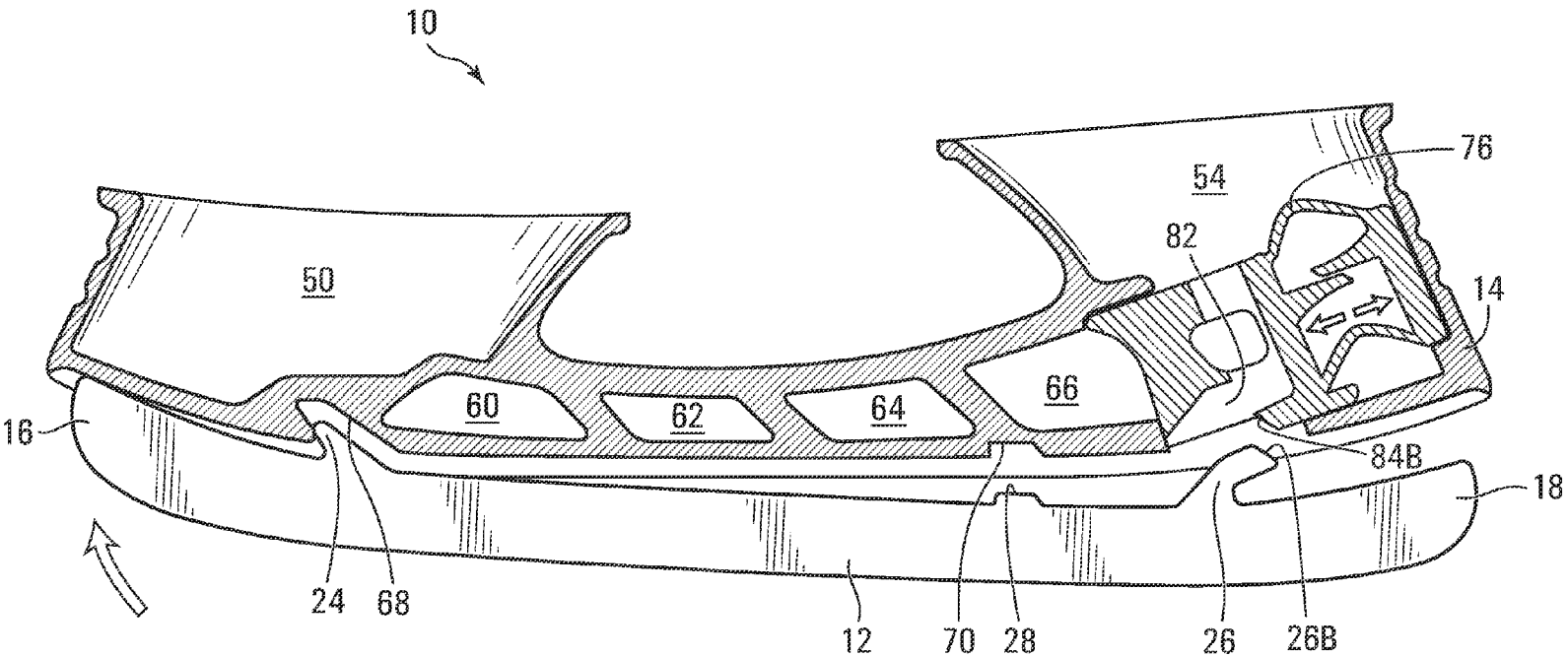
FIGS. 4 to 6 are cross-sectional views showing the process of inserting the ice skate blade within the blade holder.
Figure 5:
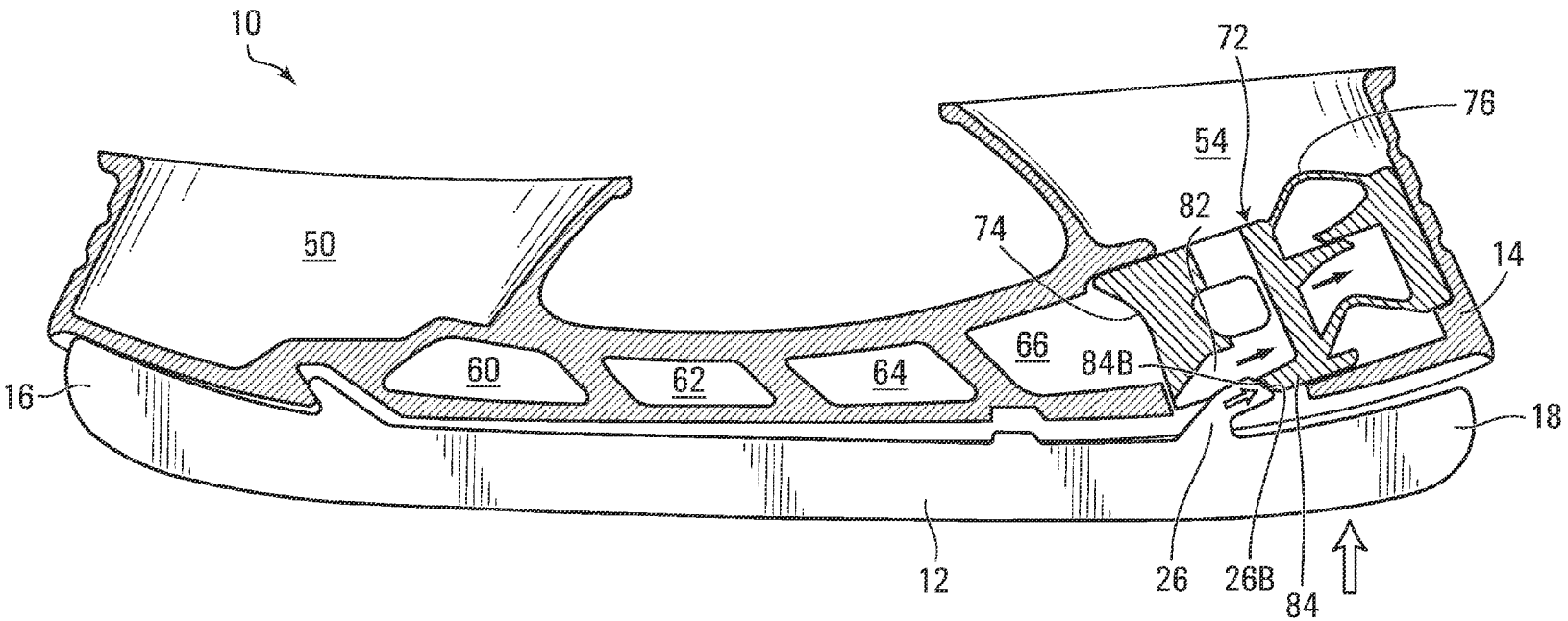
Figure 6:
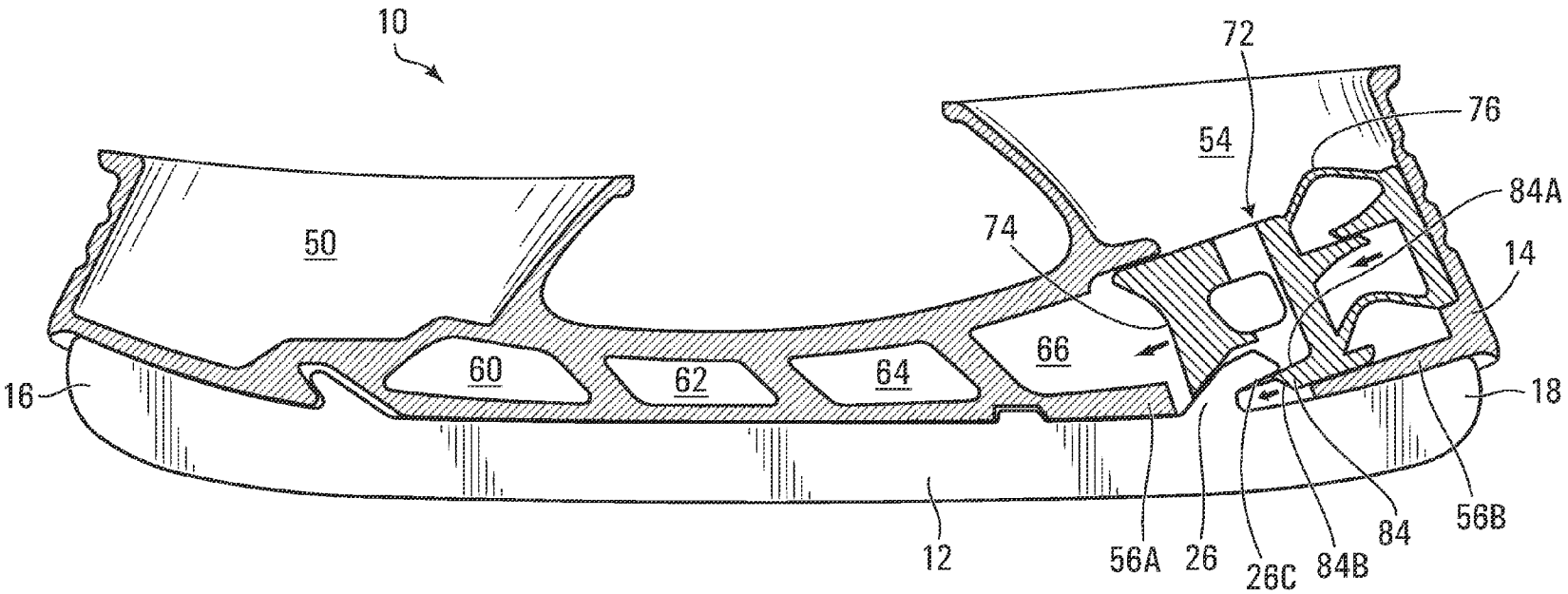

The operation of the single actuator 72 will now be described with regards to dismounting and mounting (or remounting) the ice skate blade 12. Since most ice skates are typically sold with a skate blade already installed within the blade holder, the steps of dismounting the ice skate blade 12 will be presented before the steps of remounting the ice skate blade 12 within the holder 14. FIGS. 8 to 11 show the steps by which a skate blade is dismounted while FIGS. 4 to 6 show the steps by which a blade is mounted.

Figure 8:
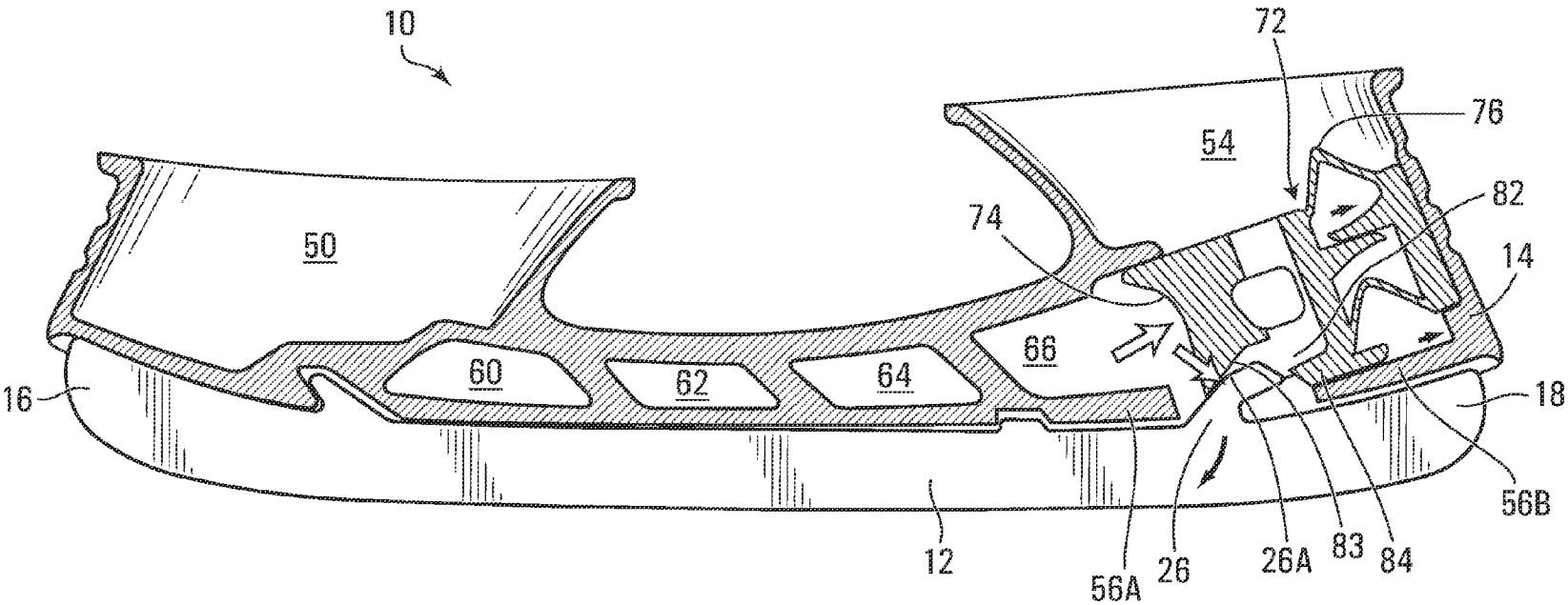
FIGS. 8 to 11 are cross-sectional views showing the process of detaching the ice skate blade from the blade holder.

To dismount or release the ice skate blade 12 from the blade holder 14, the user first inserts one or two fingers into the fourth aperture 66 for contacting the finger-accessible wall 74. The user then applies pressure (see large arrow in FIG. 8) to the finger-accessible wall 74, pressing it inwards (i.e., in the direction towards the rear of the holder 14) in order to effect the release of the ice skate blade 12 from the holder 14. In FIG. 8, the large arrow shows the pressure applied by the user.

When the user presses the finger-accessible wall 74 inwards, he is applying force that is transferred to the resilient portion 76 that is interdependent with the wall 74. Because the resilient portion 76 is elastic, it can physically deform (e.g., bend and/or compress) so as to store this additional force. In particular, when the pressure applied by the user via the finger-accessible wall 74 is greater than the tension stored within the resilient portion 76 in its equilibrium state, the resilient portion 76 is forced to compress (or bend) further such that its compression allows movement of the single actuator 72 in the direction of the end wall 78 (i.e., in the direction towards the rear of the blade holder 14) as shown by the black arrows in FIG. 8 showing translation movement of the single actuator 72.

Continuing on FIG. 8, as the relative position of the channel 82 to the second hook 26 changes upon movement of the bottom wall 84 in the rearward direction, the inner wall 83 is brought into increasing contact with the upper surface 26A of the second hook 26. The increased contact between the inner wall 83 and the upper surface 26A results in a downward force (see large arrow) being applied to the second hook 26 an in a downward movement of the ice skate blade (see black arrow).

As seen in FIG. 2, the upper surface 26A may be an inclined upper surface extending along a line that defines an angle $\theta^4$ relative to an axis parallel to the longitudinal axis A and the inner wall 83 may be an inclined inner wall extending along a line that defines an angle $\theta^3$ relative to an axis parallel to the longitudinal axis A. The angle $\theta^4$ may be between 35° and 75°. The angle $\theta^3$ may be between 35° and 75°. It is understood that the angle $\theta^3$ must be equal or slightly bigger than the angle $\theta^4$ in order to allow the second hook 26 to be tightly mounted within the channel 82. For example, the angle $\theta^3$ may be approximately 45° while the $\theta^4$ may be approximately 44°.

FIG. 8 also shows that as the bottom wall 84 moves generally rearward, it contacts and moves along the upper surface of the base wall 56B.

Figure 9:
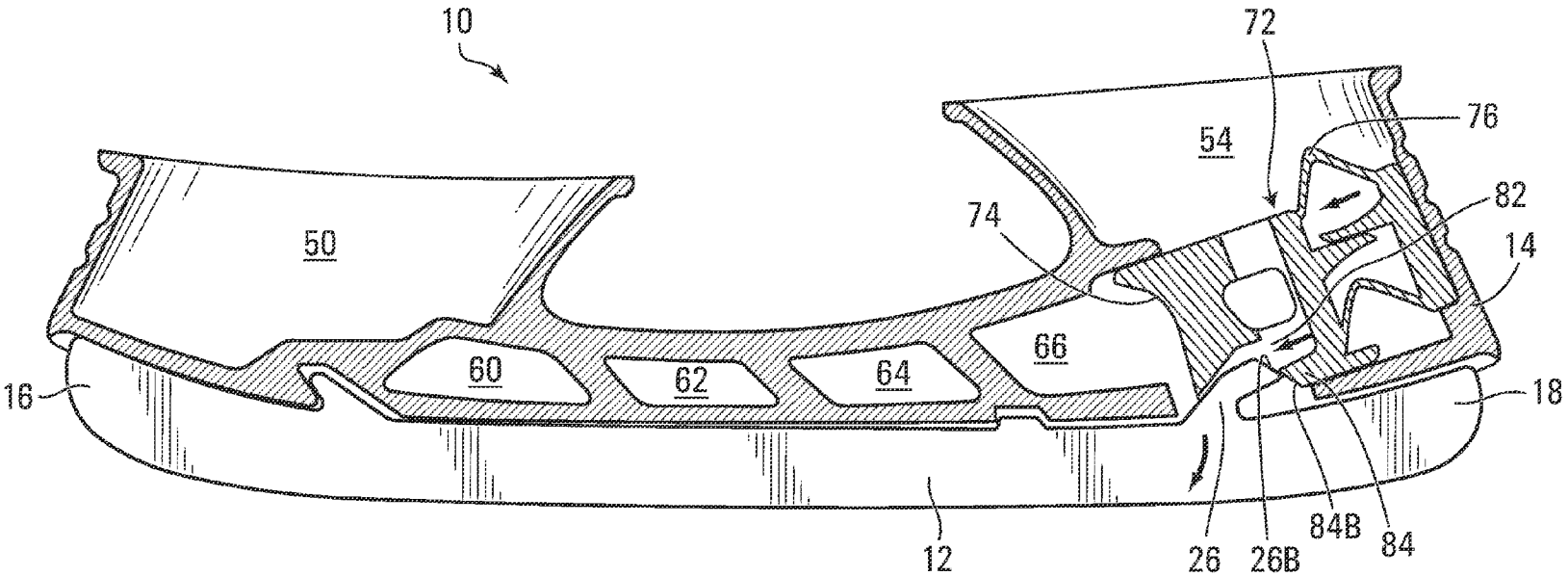
Figure 10:
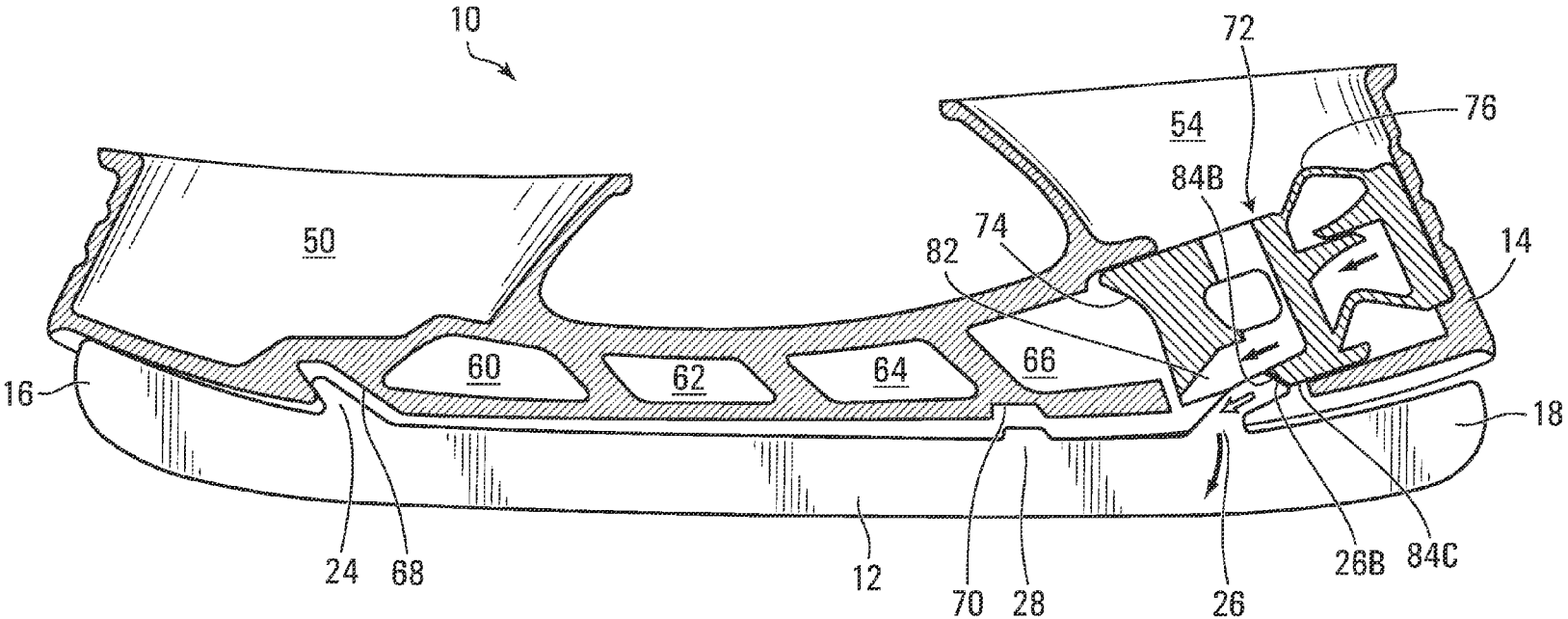

FIGS. 9 and 10 show how the pre-tension created in the single actuator 72 via the resiliency of the resilient portion 76 is now used to assist with the dismounting of the ice skate blade 12 from the blade holder 14. FIG. 9 shows the point where the ends 26B and 84B come into contact and FIG. 10 shows the point where the ends 26B and 84B are in full contact. As seen in FIG. 2, the end 26B may be an inclined end extending along a line that defines an angle $\theta^1$ relative to an axis parallel to the longitudinal axis A and the end 84B may be an inclined end extending along a line that defines an angle $\theta^2$ relative to an axis parallel to the longitudinal axis A. The angle $\theta^1$ may be between 90° and 180°. The angle $\theta^2$ may be between 0° and 90°. It is understood that the respective angles of the ends 26B, 84B must be designed such that the bottom wall 84 will allow introduction of the second hook 26 within the channel 82. For example, the angle $\theta^1$ may be approximately 121° while the $\theta^2$ may be approximately 30°.

It is understood that the ends 26B, 84B may also be a rounded ends or any other shapes that create a downward force on the second hook 26 when the bottom wall 84 moves towards the front of the holder and contacts the second hook 26. It is further understood that translation movement of the bottom end 84 and contact of the end 84B on the end 26B must create a downward force on the second hook 26 in a direction that is generally transversal relative to the longitudinal axis A (see large arrow in FIG. 10).

As shown in FIGS. 9 and 10, forward translation movement of the single actuator 72 towards the front of the blade holder 14 exerts a downward force (see large arrow) against the second hook 26 because of the increasing contact between the ends 26B, 84B and the downward force can be in a direction that is generally transversal relative to the longitudinal axis A. Hence, the portion of the force released by the resilient portion 76 via the end 84B applies downward force to the end 26B, with which it is currently in contact.

As the bottom wall 84 is driven forward by the force released by the resilient portion 76, contact between the ends 84B and 26B decreases, which coincidentally concentrates the force expressed by the resilient portion 76 (via the end 84B) into a smaller area that may help accelerate the exit of the second hook 26 from the channel 82 and/or bottom aperture 56.

Figure 11:
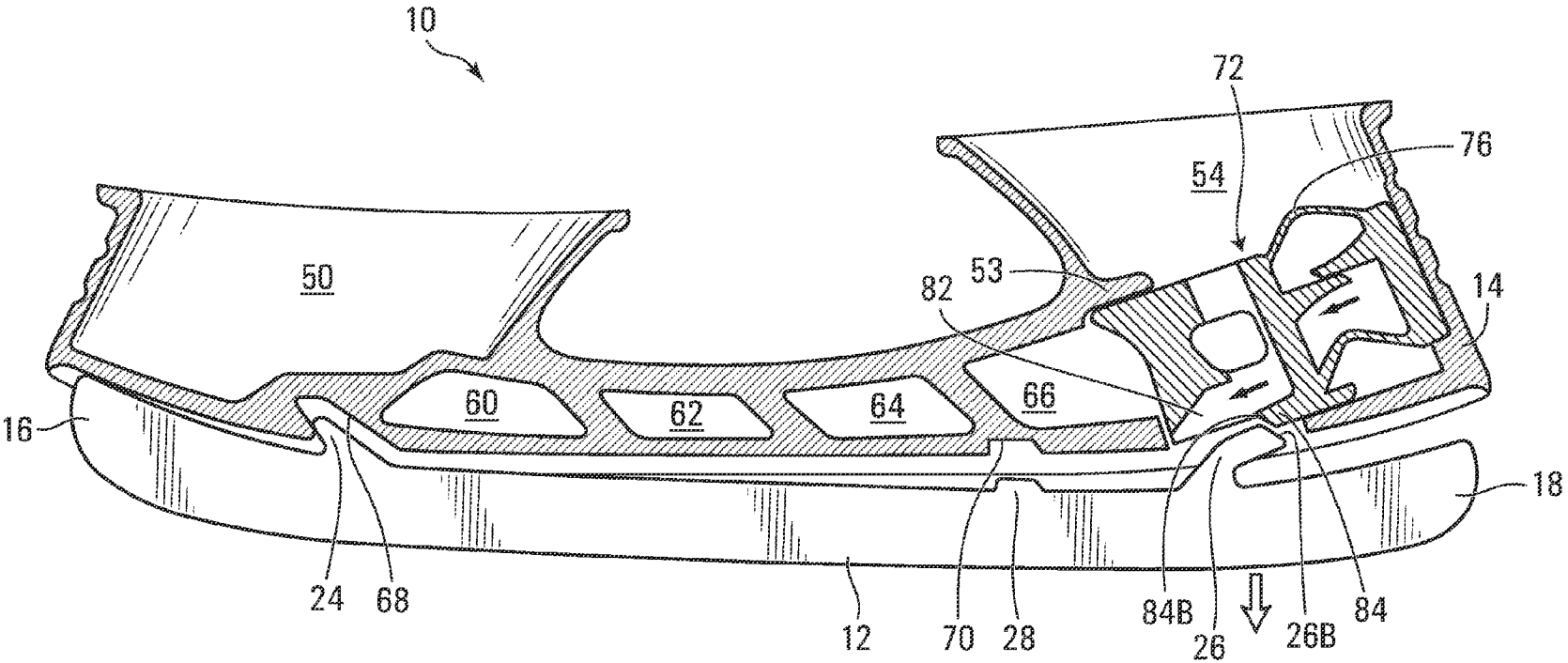

As shown in FIG. 11, the second hook 26 has exited the channel 82 and the ice skate blade 12 can simply fall down due to the gravity force (see large arrow) or the user can complete the removal of the ice skate blade 12 from the blade holder 14 by pulling down on the ice skate blade holder (see large arrow). It is understood the single actuator will return to its position shown in FIG. 2 once there is no contact between the end 84B and the end 26B.

The process by which a user mounts the ice skate blade 12 into the ice skate blade holder 14 will now be described. FIG.

4 shows that when the user wants to mount the ice skate blade 12 into the blade holder 14, he first inserts the first hook 24 into the recess 68. Once the first hook 24 has been inserted into the recess 68, this recess acts as a pivot point for the rest of the ice skate blade 12. The skate blade 12 may then be pivoted upwards in order that the second hook 26 can be inserted into the channel 82 of the single actuator 72.

When the second hook 26 approaches the channel 82, contact is first made between the end 26B of the hook 26 and the end 84B of the bottom wall 84 of the single actuator 72.

As the user applies force (see large vertical arrow in FIG. 5) to mount the ice skate blade 12 in the holder 14, this upward force is transferred from the end 26B to the end 84B in a direction that is generally transversal relative to the longitudinal axis A because of the acute angle between the end 26B and the end 84B as shown in FIG. 5. As the surface of the end 26B slides along the surface of the end 84B, the upward force applied to the bottom wall 84 is transformed into force (see large inclined arrow in FIG. 5) that creates translation movement of the single actuator 72 towards the rear end of the blade holder 14 (see black arrows in FIG. 5).

It may be recalled that the bottom wall 84 is interdependent with the resilient portion 76. As upward force is applied via the ends 26B and 84B, this force causes the bottom wall 84 to move rearward. Since the resilient portion 76 is elastic, it can physically deform (e.g., bend and/or compressed) to accommodate the rearward movement of the bottom wall 84.

FIG. 5 shows that the finger-actuated wall 74 and the channel 82 are also moving rearward with the progress of the bottom wall 84. As a result, the dimensions of the fourth aperture 66 appear to increase as a greater portion of the surface of the wall 74 is moved into the second pedestal 32.

As the user continues to apply an upward force to mount the skate blade 12, the end 26B of the second hook 26 continues in to push the end 84B such that translation movement of the single actuator 72 continues until the end 26B has cleared the end 84B and the second hook 26 entirely enters within the channel 82.

FIG. 6 shows the point at which the second hook 26 is entirely received within the channel 82 and where translation movement of the single actuator 72 towards the front end of the blade holder 14 begins. At that point, the bottom surface 26C of the second hook 26 comes into sliding contact with the upper surface 84A of the bottom wall 84, and because of the resiliency of the resilient portion 76, translation movement of the single actuator 72 towards the front of the blade holder is possible (see black arrows in FIG. 6).

Since the angle between the surfaces 26A and 84A is generally positive, the increase in sliding contact between these surfaces due to the release of force by the resilient portion 76 is transformed into an upward force that is applied by the upper surface 84A of the bottom wall 84 to the bottom surface 26C of the second hook 26 (see single large arrow in FIG. 7). This upward force causes the second hook 26 to be moved further into the channel 82 until no further translation of the bottom wall 84 is possible and the bottom wall 84 wedges the second hook 26 for locking in place the ice skate blade 12 in the longitudinal groove 40 whereby an upward force (see single large arrow in FIG. 7) is still applied by the bottom wall 84 on the second hook 26 due to the remaining tension in the resilient portion 76 (see opposing large arrows in FIG. 7).

As shown in FIG. 7, the upward force extends along a line that defines an angle $\theta^5$ relative to an axis parallel to the longitudinal axis A. According to the inclinations of the upper surface 84A of the bottom wall 84 and the bottom surface 26C of the second hook 26, the angle $\theta^5$ may be between 1° and 89°, or between 25° and 65°, or approximately 45° such that a portion of this upward force pushes the ice skate blade 12 in a direction perpendicular to the longitudinal axis A (i.e. vertical direction) and the other portion of this upward force pushes the ice skate blade 12 in a (forward) direction parallel to the longitudinal axis A (i.e. horizontal direction). In other words, the upward force has a first component extending along a direction perpendicular to the longitudinal axis A (i.e. vertical direction) and a second component extending along a direction parallel to the longitudinal axis A (i.e. horizontal direction). It is also understood that the upward force is generally perpendicular to the contacting region between the bottom wall 84 (upper surface 84A) and second hook 26 (bottom surface 26C).

In the above description, the user only applies upward force to the skate blade 12 during the mounting process. However, it is understood that the user may rather apply pressure to the finger-accessible wall 74 in order to compress the resilient portion 76, thereby moving the single actuator 72 towards the rear of the blade holder 14 such that passage of the second hook 26 into the channel 82 is not obstructed by the bottom wall 84. In an alternate way, the user may apply force to both the skate blade 12 and the finger-accessible wall 74 to mount the blade 12 within the holder 14.

The present invention also relates to an ice skate comprising an ice skate blade assembly as described above. Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. An ice skate blade assembly for a skate, the ice skate blade assembly extending along a longitudinal axis and comprising:

(a) an ice skate blade comprising first and second ends, an ice-contacting surface and an upper edge opposite to the ice-contacting surface, the upper edge comprising first and second hooks projecting upwardly proximate to one of the first and second ends respectively;

(b) a blade holder having first and second pedestals and a bridge portion connecting the first and second pedestals, the blade holder further comprising a bottom portion having a longitudinal groove extending therealong for receiving the upper edge of the ice skate blade, the bottom portion further defining a recess extending upwardly from the longitudinal groove for receiving the first hook of the ice skate blade and wherein the second pedestal has an inner surface defining a cavity with a bottom aperture that opens to the longitudinal groove; and (c) a single actuator for selectively locking the ice skate blade into the blade holder and releasing the ice skate blade from the blade holder, the single actuator being at least partially mounted within the cavity of the second pedestal and comprising a finger-engaging surface accessible by at least one finger of a user from an exterior of the blade holder and a hook-receiving portion for receiving the second hook of the ice skate blade, the hook-receiving portion being movable between (i) a lock position, in which the hook-receiving portion engages the second hook of the ice skate blade to lock the ice skate blade in the longitudinal groove of the blade holder, and (ii) a release position, in which the hook-receiving portion disengages the second hook of the ice skate blade to release the ice skate blade from the blade holder, and wherein the hook-receiving portion is movable in response to the at least one finger of the user acting on the finger-engaging surface for imparting translation movement of the single actuator from the lock position to the release position.

2. An ice skate blade assembly as defined in claim 1, wherein the hook-receiving portion comprises an inner wall and a bottom wall with an upper surface, an end and a bottom surface, the inner wall and bottom wall of the hook-receiving portion defining therebetween a channel that opens to the bottom aperture of the second pedestal for receiving the second hook of the ice skate blade.

3. An ice skate blade assembly as defined in claim 2, wherein, when the first hook is received within the recess and the second hook is received within the channel, the bottom wall of the hook-receiving portion wedges the second hook for locking in place the ice skate blade in the longitudinal groove of the blade holder.

4. An ice skate blade assembly as defined in claim 2, wherein the second hook has an upper surface, an end and a bottom surface, wherein the single actuator further comprises a resilient portion having an end wall facing a section of the inner surface of the second pedestal, and wherein, when the first hook is received within the recess and the second hook is received within the channel, the bottom wall of the hook-receiving portion wedges the second hook for locking in place the ice skate blade in the longitudinal groove of the blade holder whereby an upward force is applied by the bottom wall of the hook-receiving portion to the bottom surface of the second hook due to a remaining tension in the resilient portion of the single actuator.

5. An ice skate blade assembly as defined in claim 4, wherein, upon pressure by the user on the finger-engaging surface, the resilient portion is deformed and the translation movement of the single actuator in a first direction is imparted such that the upper surface of the bottom wall of the hook-receiving portion no longer contacts the bottom surface of the second hook and upward force is no longer applied upon the second hook by the bottom wall of the hook-receiving portion such that the second hook can exit the channel of the hook-receiving portion.

6. An ice skate blade assembly as defined in claim 5, wherein, upon pressure by the user on the finger-engaging surface, the translation movement of the single actuator along the first direction further creates a downward force on the second hook as long as the inner wall of the hook-receiving portion remains in contact with the upper surface of the second hook.

7. An ice skate blade assembly as defined in claim 6, wherein the single actuator moves in a second direction opposite to the first direction when pressure is no longer applied by the user on the finger-engaging surface.

8. An ice skate blade assembly as defined in claim 7, wherein the end of the bottom wall of the hook-receiving portion abuts the end of the second hook when the single actuator moves along the second direction such that the bottom wall of the hook-receiving portion applies a downward force on the second hook.

9. An ice skate blade assembly as defined in claim 4, wherein the end of the second hook is an inclined end and wherein the end of the bottom wall of the hook-receiving portion is an inclined end.

10. An ice skate blade assembly as defined in claim 4, wherein the inner wall of the hook-receiving portion is an inclined wall extending along a line that defines an angle $\theta^3$ relative to an axis parallel to the longitudinal axis.

11. An ice skate blade assembly as defined in claim 10, wherein the angle $\theta^3$ is between 35° and 75°.

12. An ice skate blade assembly as defined in claim 11, wherein the upper surface of the second hook is an inclined upper surface extending along a line that defines an angle $\theta^4$ relative to an axis parallel to the longitudinal axis.

13. An ice skate blade assembly as defined in claim 12, wherein the angle $\theta^4$ is between 35° and 75°.

14. An ice skate blade as defined in claim 4, wherein the end of the bottom wall of the hook-receiving portion is an inclined end extending along a line that defines an angle $\theta^2$ relative to an axis parallel to the longitudinal axis.

15. An ice skate blade assembly as defined in claim 14, wherein the angle $\theta^2$ is between 0° and 90°.

16. An ice skate blade as defined in claim 15, wherein the end of the second hook is an inclined end extending along a line that defines an angle $\theta^1$ relative to an axis parallel to the longitudinal axis.

17. An ice skate blade assembly as defined in claim 16, wherein the angle $\theta^1$ is between 90° and 180°.

18. An ice skate blade assembly as defined in claim 4, wherein the upward force is generally perpendicular to a contacting region between the upper surface of the bottom wall of the hook-receiving portion and the bottom surface of the second hook.

19. An ice skate blade assembly as defined in claim 4, wherein the upward force extends along a line that defines an angle $\theta^5$ relative to an axis parallel to the longitudinal axis.

20. An ice skate blade assembly as defined in claim 19, wherein the angle $\theta^5$ is between 25° and 65°.

21. An ice skate blade assembly as defined in claim 1, wherein the upper edge of the ice skate blade further comprises an upwardly projecting tooth located between the first and second hooks, the tooth having first and second walls extending upwardly from the upper edge and a top wall.

22. An ice skate blade assembly as defined in claim 21, wherein the bottom portion of the blade holder further defines an indent extending upwardly from the longitudinal groove, the indent having first and second walls extending downwardly and a top wall.

23. An ice skate blade assembly as defined in claim 22, wherein the indent has an internal profile that generally matches the external profile of the tooth such that one of the first and second walls of the tooth abuts against one of the first and second walls of the indent

* * * * *